United States Patent [19]

Wilson

[11] 4,226,206

[45] Oct. 7, 1980

[54] RETRACTABLE PROPULSIVE MEANS FOR SMALL BOATS

[76] Inventor: John E. Wilson, 1501 Parklane Dr., Bettendorf, Iowa 52722

[21] Appl. No.: 40,716

[22] Filed: May 21, 1979

[51] Int. Cl.[3] ..... B63H 5/12

[52] U.S. Cl. ..... 440/112; 248/640; 440/53

[58] Field of Search ..... 115/41 R, 17, 74, 18 E, 115/18 R; 114/183 R; 248/640

[56] References Cited

U.S. PATENT DOCUMENTS

| | | | |
|---|---|---|---|
| 1,786,997 | 12/1930 | Harvey | 115/41 R |
| 1,818,257 | 8/1931 | Irgens | 115/17 |
| 3,036,543 | 5/1962 | Nolt | 115/41 R |
| 3,459,150 | 8/1969 | Lunde, Jr. | 114/183 R |

*Primary Examiner*—Sherman D. Basinger
*Attorney, Agent, or Firm*—Glenn H. Antrim

[57] ABSTRACT

A motor and a propeller for a canoe are mounted to be manually positioned either within a box over an opening through the bottom of the canoe or, for operation, below both the box and the hull of the canoe. The motor is connected to the box by a usual control shaft, the control shaft extending upwardly through a supporting member and a cover of the box. Resilient grommets about the shaft and polyethylene foam insulation of the supporting member dampen noise and vibration. The supporting member moves either upwardly or downwardly with the motor and in a downward position closes the bottom of the box to prevent eddy currents within the box.

2 Claims, 3 Drawing Figures

RETRACTABLE PROPULSIVE MEANS FOR SMALL BOATS

BACKGROUND OF THE INVENTION

This invention pertains to mountings for motors and propellers of boats, and particularly to mountings adapted to retract manually motors and propellers upwardly into wells within small boats.

Retractable propelling assemblies shown in U.S. Pat. No. 1,911,192 issued to J. W. Harvey on May 30, 1933 permit propellers of the assemblies to be moved upwardly into housings within the bottoms of boats by an angular, tipping motion. While the propellers are within the housings, the boats can be run upon beaches without damage to the propelling assemblies.

Larger retractable assemblies than those used in small boats are used for driving submarines and as auxiliary assemblies for maneuvering large boats in harbors. The assemblies require mountings suitable for raising and lowering the propellers of the assemblies by remotely controlled power devices.

Retractable propelling assemblies for small boats may be readily raised and lowered manually. Such assemblies may be installed in canoes to be used for cruising to scenic streams and then raised to restore the streamline of the conoes for gliding quietly as usual.

Preferable, desirable mountings not only provide retraction, but provide easy operation, efficiency, and safety. Easy access to propellers is desirable for easy removal of tangled plants. For safety, means for raising the propellers ought to include means for preventing operation there of while the hands of operators are near the propellers. For good efficiency, the bottoms of wells into which the propelling means are to be retracted ought to be closed while the propellers are in operation directly below the wells. Furthermore, the means for closing the wells as well as other supporting means ought to dampen sound originating from rotating propellers. Since the boats are to be used either with or without the propulsive means, the main portions of the propulsive means need to be easily removed and installed.

SUMMARY OF THE INVENTION

An electric motor and an attached propeller are supported by a vertical shaft that extends upwardly through a well, or box, that is secured to the bottom of a hull of a canoe. The shaft is inserted upwardly through a supporting member positioned transversely within the walls of a box and through a sealed cover at the top of the box.

The supporting member within the box comprises a thick piece of polyethylene foam sandwiched between two metal plates. The edge of the polyethylene foam fits tightly against the inside wall of the box to form a seal, and a heavy resilient grommet about the shaft where it passes through the metal plates and the polyethylene completes a seal across the box. A gasket within the edge of the cover fits over the top edge of the wall of the box, and clasps between the cover and the sides of the box are drawn tightly to seal the top of the box.

The motor and the propeller are raised or lowered by pulling upwardly or pushing downwardly manually on a control assembly at the top of the shaft. The frictional resistance at the grommet through the supporting member is sufficient to cause the supporting member to move at all times with the shaft, the supporting member appearing like a rectangular piston within the box. The shaft is a tight sliding fit within a grommet that is through the cover. When the motor and propeller are positioned for operation below the hull, the supporting member functions as a seal to close the bottom of the box and thereby to prevent losses due to eddy currents. The polyethylene foam functions as a sound barrier to greatly dampen noise from operation of the motor and the propeller. The canoe to which the propulsive assembly is installed is guided by turning the shaft within the grommets.

DESCRIPTION OF THE PREFERRED EMBODIMENT

Figure 1:
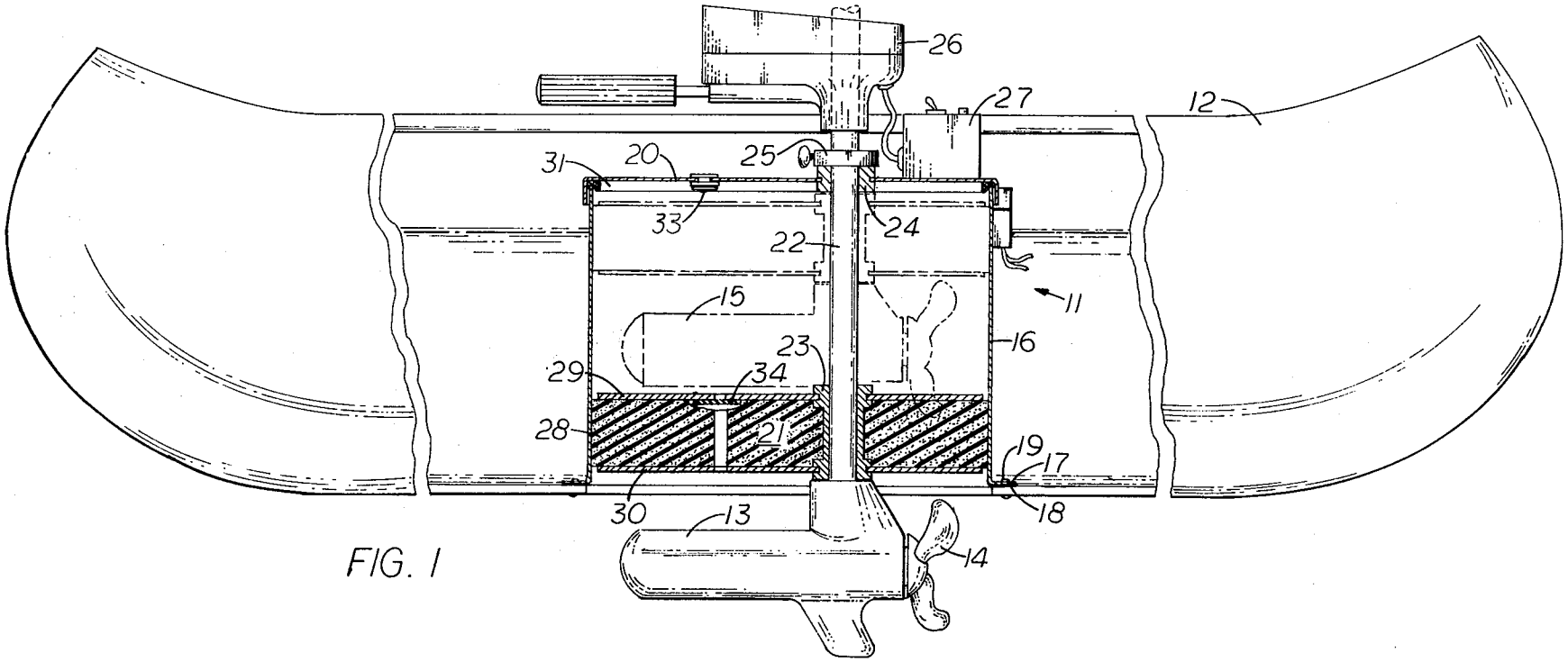
FIG. 1 is a side view of the retractable propulsive assembly of this invention, the well and the supporting members being shown in cross section on a central, longitudinal plane.
Figure 2:
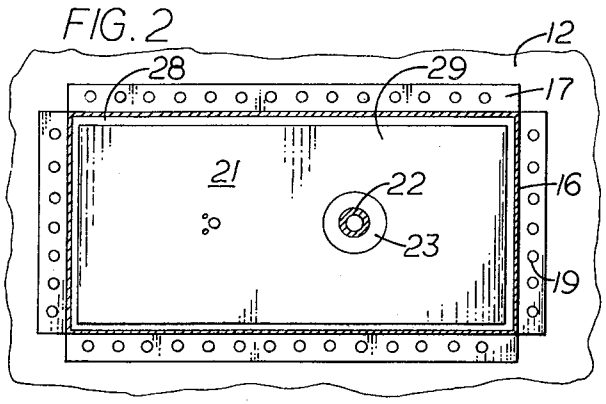
FIG. 2 is a lateral cross-sectional view of the well looking down on top of the movable supporting member.

A propulsive assembly 11 is connected to the bottom of a hull of a canoe 12 for positioning a 12-volt motor 13 and propeller 14 in an operable position below the hull of the canoe 12 as shown by a solid line in FIG. 1. When the motor 13 is retracted, it is positioned as shown by a dashed line 15 within a rectangular well or box 16 over an opening in the bottom of the hull of the canoe 12. With reference to FIGS. 1 and 2, the box 16 may have the lower edges of its ends and sides turned outwardly to form flanges 17. As shown in FIG. 1, a suitable gasket 18, that may be fabricated from cork, is positioned between the flanges 17 of the ends and sides, and then the flanges are secured by closely spaced fasteners such as rivets 19 to the edges of the bottom of the hull of the canoe, the opening through the hull having about the same dimensions as the inside dimensions of the box 16. If the canoe 12 is metal, the opening in the bottom may be cut smaller than the inside dimensions of the box 16 such that inward flanges formed about the opening may be turned upwardly a short distance within the bottom of the box 16. The length and the width of the box are sufficient to receive the motor 13 and the propeller 14, for example, a typical length of a box for a canoe is approximately 0.3 meter. The strength of the box compensates for weakening the canoe by cutting through the bottom.

A sealed cover 20 and a movable supporting member 21 within the box 16 cooperate with the sides and the ends of the box 16 to support and guide the motor 13. The motor 13 has a usual perpendicularly extending control shaft 22, and the control shaft is inserted upwardly through a resilient grommet 23 of the supporting member 21 and through a resilient grommet 24 of the cover 20. A collar 25 near the upper end of the shaft 22 is positioned at a height desired by tightening a wing screw to determine the lower position of the motor 13. The upper end of the shaft 22 is connected to a handle assembly 26, and the collar 25 is far enough below the assembly 26 for its handle to clear an electrical control box 27 attached to the top of the cover 20.

The supporting member 21 within the box 16 is thick enough to maintain the member in a firm position across the box. A thick piece of polyethylene foam 28 is sandwiched between an upper metal plate 29 and a similar lower metal plate 30. Typically, the thickness of the polyethylene foam 28 is about 5 centimeters and has the required length and width to fit tightly as a seal within the inner surfaces of the sides and ends of the box 16. Each of the plates 29 and 30 is about 2 centimeters shorter in each dimension such that the polyethylene foam 28 has a border (FIG. 2) about 1 centimeter in width between the edges of the plates 29 and 30 and the sides of the box 16. The end of the grommet 23 have a greater diameter than the intermediate portion of the grommet, and each of the ends has a circumferential groove into which the edge about a hole of a respective plate 29 and 30 fits tightly. The size of the grommet is selected with respect to the diameter of the shaft 22 such that the frictional resistance between the shaft 22 and the grommet 23 in a longitudinal direction is greater that the total frictional resistance between the edges of the polyethylene foam 28 and the sides of the box 16. Therefore, as the shaft 22 is moved either upwardly or downwardly, the position of the supporting member 21 on the shaft remains the same, and the supporting member 21 slides within the box 16.

Figure 3:
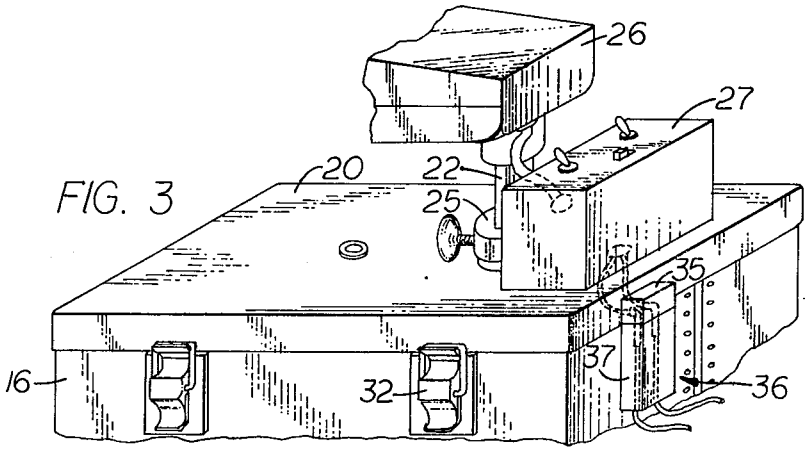
FIG. 3 is a side, perspective view of the top portion of the well and its cover.

The cover 20 has a turned down edge as shown in FIG. 1 to fit over the sides of the box 16 and has a continuous gasket 31 inside the turned down edge to provide a seal between the upper edges of the sides of the box 16 and the lower surface of the cover 20. Convenient fasteners for the cover 20 are two spaced, draw-tight clamps 32 on each side as shown in FIG. 3. The grommet 24 through the cover is located with respect to the grommet 24 to hold the shaft 22 vertically and fits tightly enough about the shaft to provide a seal.

Check valves must be provided to vent the space inside the box between the supporting member 21 and the cover 20. A check valve 33, that might be a reed type, is fastened to the lower surface of the cover 20, and likewise a similiar check valve 34 is fastened to the lower surface of the supporting member 21. Each of these check valves 33 and 34 cover a small hole through the cover 20 and the supporting member 21 respectively. As the supporting member 21 that fits somewhat like a piston is moved downwardly with the control shaft 22, the check valve 33 opens to vent air into the space within the box. As the supporting member 21 is moved upwardly, the check valve 34 opens to vent air downwardly into water below the boat. In the event that a small amount of water has accumulated above the supporting member 21, the water will be forced first through the check valve 34.

The connection of the motor 13 through suitable controls to a 12-volt battery is quite conventional except for the safety connector 36 shown at the end of box 16 in FIG. 3. The safety connector 36 has near the upper edge of the end of the box 16 a socket 37 connected to power leads from a 12-volt battery. A plug 35 is positioned at the lower edge of a turned down portion at the end of the cover 20 to mate with the socket 37 when the cover 20 is properly positioned on the box 16. The leads from the plug 35 continue through the electrical control box 27, to handle assembly 26, and downwardly through the shaft 22 to the motor 13. The control box 27 has usual off-on and reversing switches. The use of the safety connector 36 prevents injury to an operator that might otherwise result if the battery were connected directly through flexible leads to the control box 27. Particularly, when the propeller 14 becomes entangled with vegetation, the operator can readily open the clamps 32, remove the cover 20, and pull the motor 13 and propeller 14 upwardly to have access to the propeller without having to remember to disconnect the battery or to be concerned about an off-on switch being operated accidently.

After the box 16 of the propulsive assembly 11 has been installed, the canoe 12 may be used in the conventional manner without installing the rest of the assembly including the motor 13 and the propeller 14. The canoe may also be used in conventional manner after the motor 13 is installed while the handle assembly 26 and the shaft 22 are pulled upwardly to position the supporting member 21 at the top of the box 16 and the motor at the position shown by the dashed lines 15 in FIG. 1. When the motor is to be used, the handle assembly 26 is pushed downwardly to lower the motor 13 and simultaneously to position the supporting member 21 near the bottom of the box 16. As the supporting member 21 is lowered, air flows downwardly through the upper check valve 33 to prevent a partial vacuum from being formed within the box 16.

When the motor is turned on at the electrical control box 27, the supporting member 21 prevents flow of water from forming eddies in the lower portion of the box 16. Noise and vibration from the propeller 14 are greatly reduced for the operator and passengers because of the insulating qualities of the box. The resilient grommets 23 and 24 and the border of polyethylene foam 28 about the supporting member 21 prevent metal-to-metal contact between the motor 13 and the box 16. The friction between the shaft 22 and the grommets 23 and 24 is not great enough to prevent turning the motor 13, but is sufficient to retain the motor 13 in a position to which it is turned. The supporting member 21 may be considered a main support for the motor 13, and the cover 20 a guiding member to retain the shaft 22 in a vertical position. The direction of travel of the canoe 12 may be reversed either by reversing the direction of the operation of the motor 13 by operation of a switch in the control box 27 or by turning the handle assembly 26 through 180 degrees. To eliminate the drag of the motor 13 when a canoe is to be used in a usual manner, the handle assembly 26 is pulled upwardly, and while the supporting member 21 travels upwardly within the box 16, air is vented downwardly through the check valve 34.

I claim:

1. A mounting for attaching a propelling assembly to a boat, said propelling assembly being the type having an outwardly extending shaft and a control handle attached to the outer end of said shaft, said mounting comprising:

a box having a closed wall to be positioned vertically within said boat, a lower edge of said wall adapted to be sealed to the bottom of said boat about an opening through said bottom, a horizontal cover for said box detachably connected to said wall, a horizontal supporting member movable like a piston within said wall, said supporting member having a resilient peripherial portion functioning as a tight seal between said supporting member and said wall, first and second resilient grommets in a vertical line through said supporting member and through said cover respectively, said shaft extending from said propelling assembly upwardly through said first and second grommets to position said propelling assembly directly below said supporting member, said shaft movable manually in a vertical direction within said second grommet for moving said supporting member and said propelling assembly in unison between a lower position and an upper position, said first grommet fitting tightly enough about said shaft to cause said supporting member to move vertically within said closed wall while remaining at a fixed vertical distance with respect to said propelling assembly, said propelling assembly while in said upper position being positioned within said box and while in said lower position being positioned below said bottom of said boat, said supporting member while in said lower position being within a lower position of said wall to function as the bottom of said boat, and said shaft being rotatable by use of said control handle to steer said boat.

2. A mounting as claimed in claim 1 wherein said cover while attached is sealed tightly to said wall, first and second check valves through said cover and said supporting member respectively to permit flow of fluid therethrough in only a downward direction.

* * * * *